US010643531B2

(12) United States Patent
Li et al.

(10) Patent No.: US 10,643,531 B2
(45) Date of Patent: May 5, 2020

(54) CONTROL METHOD FOR PIXEL CIRCUIT, CONTROL CIRCUIT FOR PIXEL CIRCUIT AND DISPLAY DEVICE

(71) Applicant: BOE TECHNOLOGY GROUP CO., LTD., Beijing (CN)

(72) Inventors: Quanhu Li, Beijing (CN); Ling Wang, Beijing (CN); Dongfang Yang, Beijing (CN); Guang Yan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/050,099

(22) Filed: Jul. 31, 2018

(65) Prior Publication Data

US 2019/0130828 A1 May 2, 2019

(30) Foreign Application Priority Data

Oct. 26, 2017 (CN) ..... 2017 1 1021058

(51) Int. Cl.
*G09G 3/3233* (2016.01)

(52) U.S. Cl.
CPC ..... *G09G 3/3233* (2013.01); *G09G 2310/08* (2013.01); *G09G 2320/0233* (2013.01); *G09G 2320/0238* (2013.01); *G09G 2320/0295* (2013.01); *G09G 2320/045* (2013.01); *G09G 2330/021* (2013.01)

(58) Field of Classification Search
CPC ..... G09G 3/3233; G09G 2320/0295; G09G 2320/0238; G09G 2320/0233; G09G 2310/08; G09G 2330/021; G09G 2320/045
See application file for complete search history.

(56) References Cited

U.S. PATENT DOCUMENTS

| | | | | |
|---|---|---|---|---|
| 9,035,858 | B2 | 5/2015 | Kim et al. | |
| 9,336,718 | B2 * | 5/2016 | Sugihara | G09G 3/3233 |
| 2002/0047839 | A1 * | 4/2002 | Kasai | G09G 3/3233 345/211 |
| 2002/0050962 | A1 * | 5/2002 | Kasai | G09G 3/3233 345/76 |
| 2003/0160745 | A1 * | 8/2003 | Osame | G09G 3/3266 345/82 |

(Continued)

FOREIGN PATENT DOCUMENTS

| | | |
|---|---|---|
| CN | 1874627 A | 12/2006 |
| CN | 102222468 A | 10/2011 |

(Continued)

OTHER PUBLICATIONS

First Chinese Office Action dated Feb. 27, 2019, received for corresponding Chinese Application No. 201711021058.4.

*Primary Examiner* — Jose R Soto Lopez
(74) *Attorney, Agent, or Firm* — Kinney & Lange, P.A.

(57) ABSTRACT

A control method for a pixel circuit, a control circuit for a pixel circuit and a display device are provided. A timing sequence of the pixel circuit includes a driving display stage and a non-display stage. The non-display stage includes a reverse bias time period. The control method includes: inputting, in the reverse bias time period, a first control signal to an input end of the pixel circuit to make both the light-emitting element and the driving transistor to be reverse biased.

20 Claims, 3 Drawing Sheets

(56) References Cited

U.S. PATENT DOCUMENTS

2003/0214245 A1* 11/2003 Yamazaki ..... G09G 3/2011 315/169.3
2005/0212408 A1* 9/2005 Yoshida ..... G09G 3/3216 313/503
2006/0015272 A1* 1/2006 Giraldo ..... G09G 3/006 702/58
2006/0170628 A1* 8/2006 Yamashita ..... G09G 3/3233 345/76
2006/0244695 A1* 11/2006 Komiya ..... G09G 3/006 345/76
2007/0035483 A1* 2/2007 Chang ..... G09G 3/3233 345/76
2007/0080905 A1* 4/2007 Takahara ..... G09G 3/3233 345/76
2007/0152920 A1* 7/2007 Yamashita ..... G09G 3/3233 345/76
2008/0062096 A1* 3/2008 Yamashita ..... G09G 3/2074 345/82
2008/0169754 A1 7/2008 Yang et al.
2008/0198102 A1* 8/2008 Yamashita ..... G09G 3/3233 345/76
2008/0198103 A1* 8/2008 Toyomura ..... G09G 3/3233 345/77
2008/0198104 A1* 8/2008 Yamashita ..... G09G 3/3233 345/77
2008/0225027 A1* 9/2008 Toyomura ..... G09G 3/3233 345/204
2008/0278410 A1* 11/2008 Yamashita ..... G09G 3/3233 345/55
2008/0291125 A1* 11/2008 Yamashita ..... G09G 3/3233 345/55
2008/0297449 A1* 12/2008 Yamashita ..... G09G 3/3233 345/76
2009/0091562 A1* 4/2009 Uchino ..... G09G 3/3233 345/214
2009/0153448 A1* 6/2009 Tomida ..... G09G 3/3233 345/82
2009/0179838 A1* 7/2009 Yamashita ..... G09G 3/3233 345/84
2009/0184902 A1* 7/2009 Tomida ..... G09G 3/3233 345/77
2009/0189924 A1* 7/2009 Ogura ..... G09G 3/3233 345/690
2009/0201233 A1* 8/2009 Yamashita ..... G09G 3/3233 345/80
2009/0278834 A1* 11/2009 Tomida ..... G09G 3/3233 345/211
2009/0284451 A1* 11/2009 Yamamoto ..... G09G 3/3233 345/77
2010/0117932 A1* 5/2010 Yamashita ..... G09G 3/3233 345/55
2010/0117998 A1* 5/2010 Yamashita ..... G09G 3/3233 345/204
2010/0118002 A1* 5/2010 Yamashita ..... G09G 3/3233 345/205
2010/0118003 A1* 5/2010 Yamashita ..... G09G 3/3233 345/205
2010/0134468 A1* 6/2010 Ogura ..... G09G 3/3291 345/211
2010/0134469 A1* 6/2010 Ogura ..... G09G 3/3291 345/211
2010/0134482 A1* 6/2010 Ogura ..... G09G 3/3291 345/214
2010/0149079 A1* 6/2010 Yamashita ..... G09G 3/3233 345/87
2010/0149140 A1* 6/2010 Nakamura ..... G09G 3/3233 345/204
2010/0182352 A1* 7/2010 Nakamura ..... G09G 3/3233 345/691
2010/0259527 A1* 10/2010 Odawara ..... G09G 3/3233 345/211
2010/0259533 A1* 10/2010 Yamashita ..... G09G 3/3233 345/213
2010/0328297 A1* 12/2010 Shimoda ..... G09G 3/3233 345/212
2011/0074762 A1* 3/2011 Shirasaki ..... G09G 3/3225 345/211
2011/0096059 A1* 4/2011 Ohhashi ..... G09G 3/3233 345/212
2011/0141095 A1* 6/2011 Matsui ..... G09G 3/3233 345/211
2011/0193885 A1* 8/2011 Lee ..... G09G 3/3233 345/690
2012/0162176 A1* 6/2012 Kim ..... G09G 3/3258 345/211
2014/0320549 A1* 10/2014 Kumeta ..... G09G 3/3225 345/690
2015/0221252 A1 8/2015 Qing et al.
2015/0325171 A1* 11/2015 Zhou ..... G09G 3/3233 345/80
2016/0019844 A1* 1/2016 Yang ..... G09G 3/3233 345/205
2016/0063921 A1* 3/2016 Tsai ..... G09G 3/3233 345/76
2016/0063922 A1* 3/2016 Tsai ..... G09G 3/3233 345/76
2016/0071446 A1* 3/2016 Miyake ..... G09G 3/006 345/214
2016/0071447 A1* 3/2016 Takemura ..... G09G 3/2092 345/214
2016/0125803 A1 5/2016 Qing et al.
2016/0210898 A1* 7/2016 Tsuge ..... G09G 3/3233
2017/0018220 A1* 1/2017 Takahara ..... G09G 3/3233
2017/0098407 A1* 4/2017 Jeong ..... G09G 3/2051
2017/0132974 A1* 5/2017 Matsueda ..... G09G 3/3233
2017/0169796 A1* 6/2017 Tai ..... G09G 3/3233
2017/0193901 A1 7/2017 Wang et al.
2017/0262095 A1* 9/2017 Reynolds ..... G06F 3/044
2017/0345368 A1* 11/2017 Kim ..... G09G 3/3233
2017/0365224 A1* 12/2017 Okamoto ..... H01L 29/786
2018/0061294 A1* 3/2018 Kim ..... G09G 3/006
2018/0108426 A1 4/2018 Zheng et al.
2018/0151656 A1* 5/2018 Choo ..... G09G 3/3233
2018/0158401 A1* 6/2018 Wang ..... G09G 3/3225
2018/0158414 A1* 6/2018 Lee ..... G09G 3/3258
2018/0357966 A1* 12/2018 Ma ..... G09G 3/3291

FOREIGN PATENT DOCUMENTS

CN 103366682 A 10/2013
CN 103440843 A 12/2013
CN 104217674 A 12/2014
CN 105047138 A 11/2015
CN 105427806 A 3/2016
CN 105528985 A 4/2016
KR 100833756 B1 5/2008
KR 20080054764 A 6/2008
KR 20080113528 A 12/2008

* cited by examiner

CONTROL METHOD FOR PIXEL CIRCUIT, CONTROL CIRCUIT FOR PIXEL CIRCUIT AND DISPLAY DEVICE

CROSS-REFERENCE TO RELATED APPLICATION

This application claims a priority to Chinese Patent Application No. 201711021058.4 filed on Oct. 26, 2017, the disclosure of which is incorporated in its entirety by reference herein.

TECHNICAL FIELD

The present disclosure relates to the field of display technology, in particular to a control method for a pixel circuit, a control circuit for a pixel circuit and a display device.

BACKGROUND

Organic light-emitting diode (OLED) technology is one of the current research hotspots in flat-panel displays. Compared with a liquid crystal display (LCD), the OLED display has advantages such as low power consumption, low fabrication cost, self-illumination, wide viewing angle and high response speed. Currently in display fields such as cellular phone, tablet computer and digital camera, the OLED display has replaced the conventional LCD.

The LCD controls the brightness using a stabilized voltage. Different from that, the OLED is driven by current, and it requires a stabilized current to control luminance. Usually, for an OLED display, a current is input to the OLED through a driving transistor in a pixel circuit of each pixel, thereby driving the OLED to emit light.

As found by the inventor, the driving transistor spends a lot of time in driving the light-emitting element to emit light, so both the driving transistor and the OLED are in a forward biased state for a long time. As a result, electric characteristic drifts are generated in the driving transistor and the OLED, the service lives of the driving transistor and the OLED are shortened, and the current efficiency is decreased.

SUMMARY

In one aspect, an embodiment of the present disclosure provides a control method for a pixel circuit. The pixel circuit includes a driving transistor configured to drive a light-emitting element. A timing sequence of the pixel circuit includes a driving display stage and a non-display stage, and the non-display stage includes a reverse bias time period. The control method includes: inputting, in the reverse bias time period, a first control signal to an input end of the pixel circuit to make both the light-emitting element and the driving transistor to be reverse biased.

Optionally, the input end of the pixel circuit includes: a first scanning end, a second scanning end, a first power supply end, a second power supply end, a data signal end and a reference input end. The inputting, in the reverse bias time period, the first control signal to the input end of the pixel circuit includes: inputting corresponding signals to the first scanning end, the second scanning end, the data signal end, the reference input end, the first power supply end and the second power supply end, respectively. The reverse bias time period is a time period preselected from the non-display stage.

Optionally, the pixel circuit includes a first switching transistor, a second switching transistor and a storage capacitor, and the light-emitting element is a light-emitting diode. A gate electrode of the driving transistor is connected to the data signal end via the first switching transistor, a first electrode of the driving transistor is connected to the first power supply end, and a second electrode of the driving transistor is connected to an anode of the light-emitting diode. The storage capacitor is arranged between the gate electrode and the second electrode of the driving transistor and is connected with the gate electrode and the second electrode of the driving transistor. The reference input end is connected to the anode of the light-emitting diode and the gate electrode of the driving transistor via the second switching transistor, and a cathode of the light-emitting diode is connected to the second power supply end. In the reverse bias time period, a voltage of the signal at the second power supply end is higher than a voltage of the signal at the reference input end, the voltage of the signal at the reference input end is higher than a voltage of the signal at the first power supply end, and the voltage of the signal at the first power supply end is higher than a voltage of the signal at the data signal end.

Optionally, the voltage of the signal at the first power supply end in the reverse bias time period is lower than a voltage of the signal at the first power supply end in the driving display stage.

Optionally, the voltage of the signal at the second power supply end in the reverse bias time period is higher than a voltage of the signal at the second power supply end in the driving display stage.

Optionally, a difference between voltages of the signals at the reference input end and the data signal end in the reverse bias time period is higher than a first threshold.

Optionally, a voltage of the signal at the data signal end in the reverse bias time period is lower than a threshold voltage of the driving transistor.

Optionally, a gate electrode of the first switching transistor is connected to the first scanning end, a first electrode of the first switching transistor is connected to the data signal end, and a second electrode of the first switching transistor is connected to the gate electrode of the driving transistor. A gate electrode of the second switching transistor is connected to the second scanning end, a first electrode of the second switching transistor is connected to the reference input end, and a second electrode of the second switching transistor is connected to the anode of the light-emitting diode and the gate electrode of the driving transistor. The first switching transistor, the second switching transistor and the driving transistor each is an N-type thin-film transistor. In the reverse bias time period, each of the signals at the first scanning end, the second scanning end and the second power supply end is a high level, each of the signals at the first power supply end and the data signal end is a low level, the first switching transistor and the second switching transistor are each switched on, the low level signal at the data signal end is input to the gate electrode of the driving transistor via the first switching transistor to make the driving transistor to be reverse biased. The signal at the reference input end is input to the anode of the light-emitting diode via the second switching transistor, the signal input to the cathode of the light-emitting diode from the second power supply end is higher than the voltage of the signal at the reference input end in such a manner that the light-emitting diode is reverse biased.

In a second aspect, an embodiment of the present disclosure further provides a control circuit for a pixel circuit. The pixel circuit includes a driving transistor configured to drive a light-emitting element. A timing sequence of the pixel circuit includes a driving display stage and a non-display stage, and the non-display stage includes a reverse bias time period. The control circuit is connected to an input end of the pixel circuit and is configured to input a first control signal to the input end of the pixel circuit in the reverse bias time period to make both the light-emitting element and the driving transistor to be reverse biased.

Optionally, the input end of the pixel circuit includes: a first scanning end, a second scanning end, a first power supply end, a second power supply end, a data signal end and a reference input end. The control circuit is configured to, in the reverse bias time period, input corresponding signals to the first scanning end, the second scanning end, the data signal end, the reference input end, the first power supply end and the second power supply end respectively. The reverse bias time period is a time period preselected from the non-display stage Optionally, the pixel circuit includes a first switching transistor, a second switching transistor and a storage capacitor, and the light-emitting element is a light-emitting diode. A gate electrode of the driving transistor is connected to the data signal end via the first switching transistor, a first electrode of the driving transistor is connected to the first power supply end, and a second electrode of the driving transistor is connected to an anode of the light-emitting diode. The storage capacitor is arranged between the gate electrode and the second electrode of the driving transistor and is connected with the gate electrode and the second electrode of the driving transistor. The reference input end is connected to the anode of the light-emitting diode and the gate electrode of the driving transistor via the second switching transistor, and a cathode of the light-emitting diode is connected to the second power supply end. In the reverse bias time period, a voltage of the signal at the second power supply end is higher than a voltage of the signal at the reference input end, the voltage of the signal at the reference input end is higher than a voltage of the signal at the first power supply end, and the voltage of the signal at the first power supply end is higher than a voltage of the signal at the data signal end.

Optionally, the voltage of the signal at the first power supply end in the reverse bias time period is lower than a voltage of the signal at the first power supply end in the driving display stage.

Optionally, the voltage of the signal at the second power supply end in the reverse bias time period is higher than a voltage of the signal at the second power supply end in the driving display stage.

Optionally, a difference between voltages of the signals at the reference input end and the data signal end in the reverse bias time period is higher than a first threshold.

Optionally, a voltage of the signal at the data signal end in the reverse bias time period is lower than a threshold voltage of the driving transistor.

In a third aspect, an embodiment of the present disclosure further provides a display device, including the above-described pixel circuit and control circuit.

BRIEF DESCRIPTION OF THE DRAWINGS

To better clarify technical solutions in embodiments of the present disclosure or conventional art, drawings to be used in describing the embodiments are briefly introduced hereinafter. Apparently, the following described drawings are merely for a part of the embodiments of the present disclosure. Those of ordinary skill in the art can obtain other drawings based on these disclosed drawings without making creative efforts.

DETAILED DESCRIPTION

Figure 1:
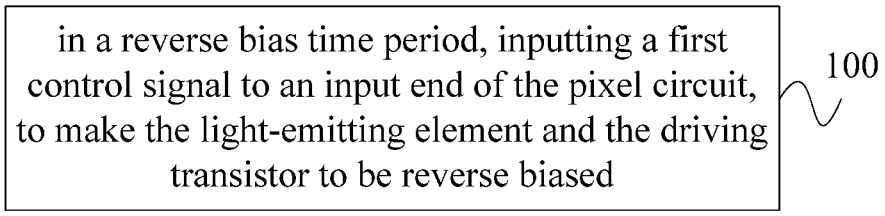
FIG. 1 is a flowchart of a control method for a pixel circuit according to an embodiment of the present disclosure.

To clarify objectives, technical solutions and advantages of the present disclosure, embodiments of the present disclosure are to be detailed in conjunction with drawings. It should be noted that, in case of no conflict, the embodiments in the present disclosure can be combined arbitrarily and features in the embodiments can be combined arbitrarily.

Unless otherwise defined, technical terms or scientific terms used in the present disclosure shall have common meanings understood by the ordinary skilled in the art. Terms such as "first" and "second" in the present disclosure do not indicate any order, quantity of importance, they are merely used to distinguish different components. Terms such as "include" or "contain" indicate that an element or object before such terms covers an element, an object or the equivalent enumerated after such terms, and do not exclude other elements and objects. Terms such as "coupled" and "connected" are not used to limit physical or mechanical connections, they can be direct or indirect electrical connections.

As can be understood by those of ordinary skill in the art, all switching transistors and driving transistors used in the embodiments may be thin-film transistors, field-effect transistors or other components having similar characteristics. Optionally, thin-film transistors in the embodiments of the present disclosure may be oxide semiconductor transistors. Here a source electrode and a drain electrode of the switching transistor are symmetrical, so the source electrode and the drain electrode can be interchanged. In the embodiments of the present disclosure, in order to distinguish two electrodes other than the gate electrode, one electrode is called as a first electrode and the other electrode is called as a second electrode. The first electrode may be the source electrode or the drain electrode, and correspondingly, the second electrode may be the drain electrode or the source electrode.

As found by the inventor, when driving transistors in pixel circuits in related technology drive OLEDs to emit light to perform displaying, both the driving transistors and the OLEDs are in a forward biased state. In a case that a difference between voltages at the gate electrode and the source electrode is relatively large, the driving transistor may capture electrons; hence, a threshold voltage of the driving transistor is increased, the service life of the driving transistor is shortened, a current flowing through the OLED is decreased and brightness of the OLED is decreased. In addition, when displaying is performed under the drive of the pixel circuits, the OLED is in the forward biased state and may capture electrons. Hence, the OLED may generate electric characteristic drifts, the service life of the OLED is shortened, and the current efficiency of the OLED is decreased.

In view of the above technical problems, embodiments of the present disclosure provide a control method for a pixel circuit, a control circuit for a pixel circuit and a display device, to eliminate the electric characteristic drifts in the driving transistor and the OLED and to recover the current efficiency, and to prolong service lives of the driving transistor and the OLED.

FIG. 1 is a flowchart of a control method for a pixel circuit according to an embodiment of the present disclosure. The pixel circuit includes a driving transistor configured to drive a light-emitting element. As shown in FIG. 1, the control method for the pixel circuit specifically includes:

step 100, in a reverse bias time period, inputting a first control signal to an input end of the pixel circuit, to make the light-emitting element and the driving transistor to be reverse biased.

It should be noted that a timing sequence of the pixel circuit includes a driving display stage and a non-display stage. The non-display stage includes the reverse bias time period. The reverse bias time period in embodiments of the present disclosure is a time period preselected from the non-display stage.

Optionally, the light-emitting element may be an organic light-emitting diode OLED.

Figure 2:
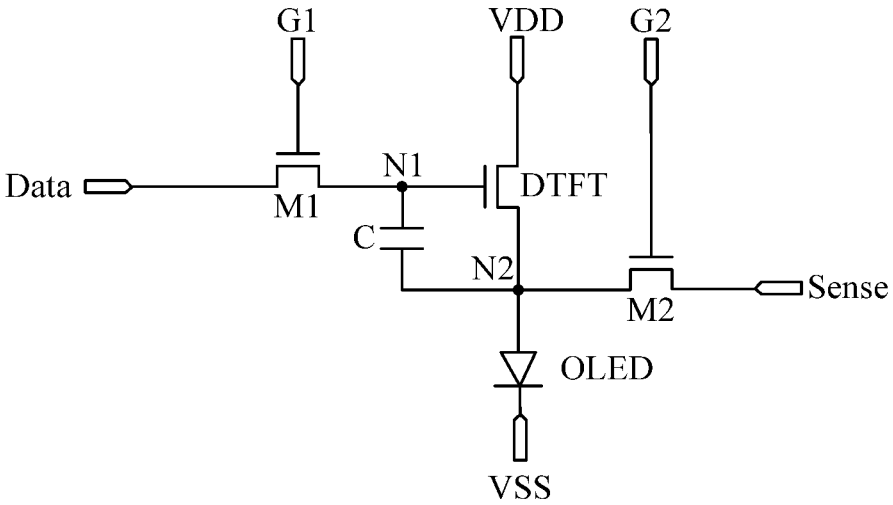
FIG. 2 is an equivalent circuit diagram of a pixel circuit according to an embodiment of the present disclosure.

FIG. 2 is an equivalent circuit diagram of a pixel circuit according to an embodiment of the present disclosure. As shown in FIG. 2, the pixel circuit includes: a driving transistor DTFT, a first switching transistor M1, a second switching transistor M2, a storage capacitor C and an organic light-emitting diode OLED. An input end of the pixel circuit includes: a first scanning end G1, a second scanning end G2, a first power supply end VDD, a second power supply end VSS, a data signal end Data and a reference input end Sense.

Optionally, a gate electrode of the driving transistor DTFT is connected with a first node N1, a source electrode of the driving transistor DTFT is connected with a second node N2, and a drain electrode of the driving transistor DTFT is connected with the first power supply end VDD. The driving transistor DTFT is configured to supply, under control of the first node N1 and the first power supply end VDD, a driving current to the second node N2, and the driving current is configured to drive the organic light-emitting diode OLED.

Optionally, a gate electrode of the first switching transistor M1 is connected with the first scanning end G1, a first electrode of the first switching transistor M1 is connected with the data signal end Data, and a second electrode of the first switching transistor M1 is connected with the first node N1. The first switching transistor M1 is configured to supply, under control of the first scanning end G1, a signal from the data signal end Data to the first node N1.

Optionally, a gate electrode of the second switching transistor M2 is connected with the second scanning end G2, a first electrode of the second switching transistor M2 is connected with the second node N2, and a second electrode of the second switching transistor M2 is connected with the reference input end Sense. The second switching transistor M2 is configured to supply, under control of the second scanning end G2, a signal from the reference input end Sense to the second node N2.

Optionally, one end of the storage capacitor C is connected with the first node N1 and the other end is connected to the second node N2. The storage capacitor is configured to store a voltage difference between the first node N1 and the second node N2.

Optionally, an anode of the organic light-emitting diode OLED is connected with the second node N2, and a cathode of the OLED is connected to the second power supply end VSS.

Specifically, step 100 includes: input corresponding signals to the first scanning end G1, the second scanning end G2, the data signal end Data, the reference input end Sense, the first power supply end VDD and the second power supply end VSS, respectively.

In the embodiment, each of the transistors M1 and M2 may be an N-type thin-film transistor or a P-type thin-film transistor, so the manufacturing flow for the transistors can be unified and manufacturing processes can be reduced, helping improving the yield of products. In addition, considering that a leakage current of a low-temperature poly-silicon thin-film transistor is relatively small, so preferably in some embodiments of the present disclosure, all transistors are low-temperature poly-silicon thin-film transistors. The thin-film transistors may have a bottom-gate structure or a top-gate structure as long as a switching function can be achieved.

It should be noted that, the storage capacitor may be a liquid crystal capacitor formed by a pixel electrode and a common electrode, or may be an equivalent capacitor composed by a storage capacitor and the liquid crystal capacitor formed by the pixel electrode and the common electrode, which is not limited herein.

Technical solutions of embodiments of the present disclosure are further described based on an operating procedure of the pixel circuit.

Figure 3:
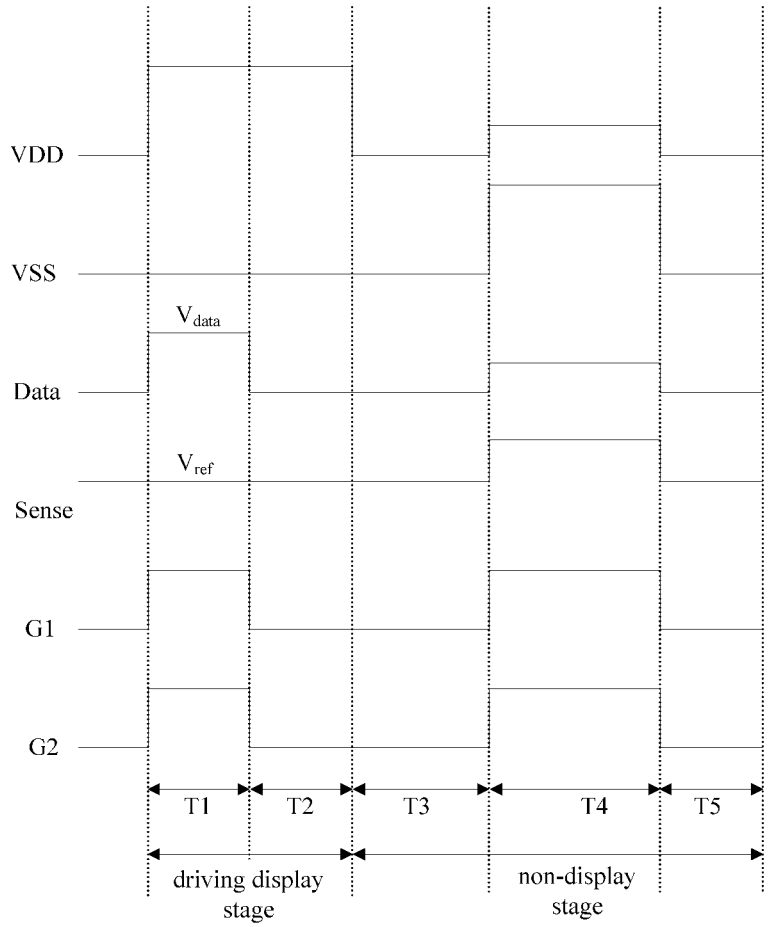
FIG. 3 is a timing sequence diagram of control signals of a pixel circuit according to an embodiment of the present disclosure.
Figure 4:
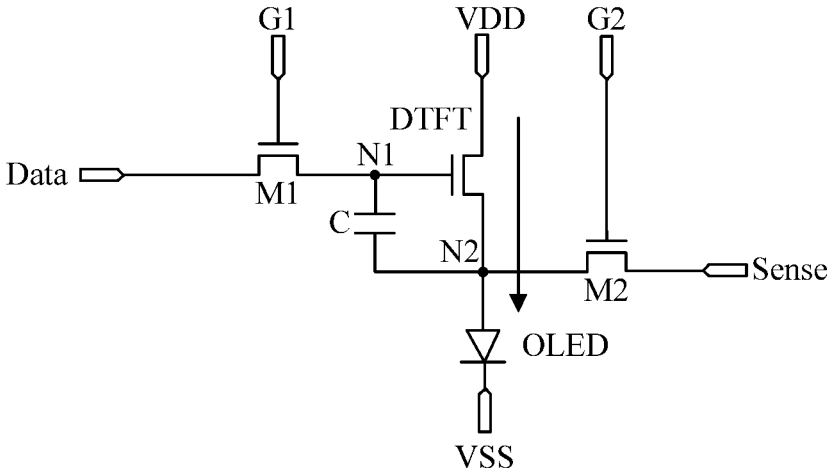
FIG. 4 is a diagram showing an operating state of a pixel circuit in a driving display stage according to an embodiment of the present disclosure.
Figure 5:
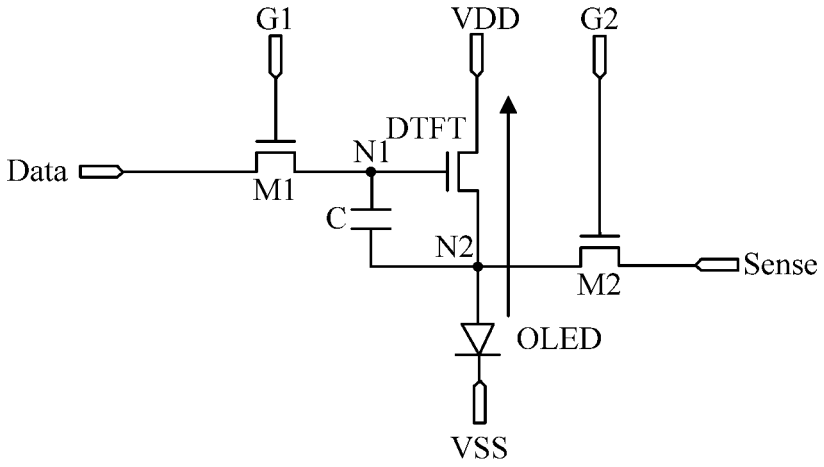
FIG. 5 is a diagram showing an operating state of a pixel circuit in a non-display stage according to an embodiment of the present disclosure.

It is described based on a case that transistors M1 and M2 in the pixel circuit according to the embodiments of the present disclosure are all N-type thin-film transistors. FIG. 3 is a timing sequence diagram of control signals of a pixel circuit according to an embodiment of the present disclosure. FIG. 4 is a diagram showing an operating state of a pixel circuit in a driving display stage according to an embodiment of the present disclosure. FIG. 5 is a diagram showing an operating state of a pixel circuit in a non-display stage according to an embodiment of the present disclosure. As shown in FIG. 2 to FIG. 5, a pixel circuit according to an embodiment of the present disclosure includes: two switching transistors M1 and M2, one driving transistor DTFT, one capacitor C and six input ends (the first scanning end G1, the second scanning end G2, the first power supply end VDD, the second power supply end VSS, the data signal end Data and the reference input end Sense).

It should be noted that the operating procedure of the pixel circuit includes the driving display stage and the non-display stage, and a reverse bias time period is a time period preselected from the non-display stage.

The driving display stage includes a first stage T1 and a second stage T2.

In the first stage T1, as shown in FIG. 4, a signal at the first scanning end G1 and a signal at the second scanning end G2 are high levels; the first switching transistor M1 is switched on and supplies the first node N1 with a signal from the data signal end Data; a voltage at the first node N1 is pulled up and the storage capacitor C is charged, here, the voltage V1 at the first node N1 is equal to $V_{data}$. The second switching transistor M2 is switched on and supplies the second node N2 with a signal from the reference input end Sense, here, a voltage V2 at the second node N2 is equal to $V_{ref}$. A difference between voltages of the first node N1 and the second node N2 is higher than a threshold voltage $V_{th}$ of the driving transistor DTFT, so the driving transistor DTFT is turned on, the first power supply end VDD supplies a driving current to the anode of the organic light-emitting diode OLED and the organic light-emitting diode OLED emits light.

In the first stage T1, signals at the first scanning end G1, the second scanning end G2, the signal data end Data and the reference input end Sense among the input ends are high levels, a signal at the first power supply end VDD is a high level and a signal at the second power supply end VSS is a low level.

In the second stage T2, as shown in FIG. 4, signals at the first scanning end G1 and the second scanning end G2 are low levels, the first switching transistor M1 and the second switching transistor M2 are switched off, the voltage stored in the storage capacitor C maintains the driving transistor DTFT in a turning-on state, the first power supply end VDD continuously pulls up the voltage at the second node N2 and the organic light-emitting diode OLED continuously emits light until the voltage at the second node N2 is equal to $V_{data}-V_{th}$, then the driving transistor DTFT is turned off and the organic light-emitting diode OLED stops emitting light.

In the second stage T2, signals at the first scanning end G1, the second scanning end G2, the signal data end Data and the reference input end Sense among the input ends are low levels, a signal at the first power supply end VDD is a high level and a signal at the second power supply end VSS is a low level.

It should be noted, in order to ensure that the organic light-emitting diode OLED emits light normally in the driving display stage, the organic light-emitting diode OLED and the driving transistor DTFT should both be forward biased, the following should be meet: in the first stage, a voltage of a signal at the first power supply end VDD is higher than a voltage of a signal at the signal data end Data, the voltage of the signal at the signal data end Data is higher than a voltage of a signal at the reference input end Sense, and the voltage of the signal at the reference input end Sense is higher than a voltage of a signal at the second power supply end VSS.

The non-display stage includes a third stage T3, a fourth stage T4 and a fifth stage T5.

In the third stage T3, signals at all the input ends are low levels, here, the pixel circuit does not emit light.

In the fourth stage T4, i.e., in the reverse bias time period, signals at the first scanning end G1 and the second scanning end G2 are high levels, the first switching transistor M1 and the second switching transistor M2 are switched on; a signal from the data signal end Data is supplied to the first node N1, a voltage at the first node N1 is pulled down and the driving transistor DTFT is reverse biased, here, the voltage V1 at the first node N1 is equal to $V_{data}$; the second switching transistor M2 is switched on and a signal from the reference input end Sense is supplied to the second node N2, here a voltage V2 at the second node N2 is equal to $V_{ref}$.

In the fourth stage T4, signals at the first scanning end G1 and the second scanning end G2 are high levels, and a signal at the first power supply end VDD is a low level and a signal at the second power supply end VSS is a high level. The voltage of the signal at the second power supply end VSS is higher than the voltage of the signal at the first power supply end VDD. The voltage of the signal at the first power supply end VDD is higher than the voltage of the signal at the data signal end Data.

As shown in FIG. 5, the anode of the organic light-emitting diode OLED is connected with the second node N2 whose voltage is equal to the voltage of the signal at the reference input end Sense, the cathode of the organic light-emitting diode OLED is connected to the signal at the second power supply end VSS, since the voltage of the signal at the second power supply end VSS is higher than the voltage of the signal at the reference input end Sense, the organic light-emitting diode OLED is reverse biased, partial electrons captured in a forward bias in the driving display stage are recovered; hence, electric characteristic drifts in the OLED are eliminated, the current efficiency is recovered, and the service life of the OLED is prolonged.

In addition, the gate electrode of the driving transistor DTFT is connected to the first node N1 whose voltage is equal to the voltage of the signal at the signal data end Data; the source electrode is connected with the second node N2 whose voltage is equal to the voltage of the signal at the reference input end Sense, and the drain electrode is connected to the signal at the first power supply end VDD. Since the voltage of the signal at the data signal end Data is lower than the voltage of the signal at the reference input end Sense and the voltage of the signal at the reference input end Sense is higher than the voltage at the first power supply end VDD, the driving transistor DTFT is reverse biased. Partial electrons captured in a forward bias in the driving display stage are recovered; hence, electric characteristic drifts in the OLED are eliminated, the current efficiency is recovered, and the service life of the OLED is prolonged.

In the fifth stage T5, after reverse biases of the organic light-emitting diode OLED and the driving transistor DTFT are finished, signals at all input ends are low levels until high level signals are input to the first scanning end G1 and the second scanning end G2 again.

It should be noted, signals at the first power supply end VDD, the second power supply end VSS, the reference input end Sense and the data signal end Data in the first stage T1 differ from signals at the first power supply end VDD, the second power supply end VSS, the reference input end Sense and the data signal end Data in the fourth stage T4.

Optionally, the voltage of the signal at the first power supply end VDD in the fourth stage is lower than the voltage of the signal at the first power supply end VDD in the driving display stage.

Optionally, the voltage of the signal at the second power supply end VSS in the fourth stage is higher than the voltage of the signal at the second power supply end VSS in the driving display stage.

Optionally, in order to recover the threshold voltage effectively, a difference between voltages of signals at the reference input end Sense and the data signal end Data in the fourth stage is higher than a preset threshold.

Optionally, the voltage of the signal at the data signal end Data in the fourth stage is lower than the threshold voltage of the driving transistor DTFT.

It should be noted that it is described based on the case that the transistors M1 and M2 are N-type thin-film transistors in the embodiment of the present disclosure; transistors M1 to M2 can be P-type thin-film transistors, here, a condition for switching on the transistors M1 to M2 is to input low level signals.

Furthermore, in the embodiment of the present disclosure, the reverse biases of the organic light-emitting diode OLED and the driving transistor DTFT are achieved merely by inputting different control signals to the six input ends in the reverse bias time period without using additional devices. Hence, the pixel circuit has a simple structure and meanwhile the service lives of the driving transistor and the OLED are prolonged.

The control method for the pixel circuit according to the embodiment of the present disclosure includes: in a reverse bias time period, inputting a first control signal to an input end of the pixel circuit to make a light-emitting element and a driving transistor to be reverse biased. The reverse bias time period is a time period preselected from the non-display stage. In the embodiment of the present disclosure, electrons captured when the light-emitting element and the driving transistor are reverse biased can be recovered by realizing reverse biases of the light-emitting element and the driving transistor in the reverse bias time period, which not only eliminates electric characteristic drifts in the driving transistor and the OLED and recovers the current efficiency, but also prolongs service lives of the driving transistor and the OLED.

Based on the inventive concept of the above embodiments, a control circuit for a pixel circuit is provided according to an embodiment of the present disclosure. Corresponding to the control method for the pixel circuit according to the foregoing embodiments, the pixel circuit includes a driving transistor configured to drive a light-emitting element to emit light. A timing sequence of a control signal includes: a driving display stage and a non-display stage. The non-display stage includes the reverse bias time period. The control circuit is connected with the input end of the pixel circuit and is configured to input a first control signal to the input end of the pixel circuit in the reverse bias time period to make the light-emitting element and the driving transistor to be reverse biased.

It should be noted that the reverse bias time period in the embodiment is a time period preselected from the non-display stage.

Optionally, the light-emitting element may be an organic light-emitting diode OLED.

Optionally, the input end of the pixel circuit includes: a first scanning end, a second scanning end, a first power supply end, a second power supply end, a data signal end and a reference input end.

The control circuit is specifically configured to input corresponding signals to the first scanning end, the second scanning end, the data signal end, the reference input end, the first power supply end and the second power supply end in the reverse bias time period.

Specifically, in the reverse bias time period, the signals at the first scanning end and the second scanning end are high levels, the signal at the first power supply end is a low level and the signal at the second power supply end is a high level. A voltage of the signal at the second power supply end is higher than a voltage of the signal at the reference input end, the voltage of the signal at the reference input end is higher than a voltage of the signal of the first power supply end, and the voltage of the signal of the first power supply end is higher than a voltage of the signal at the data signal end.

A voltage at an anode of the organic light-emitting diode is equal to the voltage of the signal at the reference input end, the cathode is connected to the signal at the second power supply end. Since the voltage of the signal at the second power supply end is higher than the voltage of the signal at the reference input end, the organic light-emitting diode is reverse biased, partial electrons captured in a forward bias in the driving display stage are recovered; hence, electric characteristic drifts in the OLED are eliminated, the current efficiency is recovered, and the service life of the OLED is prolonged.

In addition, a voltage at a gate electrode of the driving transistor is equal to the voltage of the signal at the data signal end, a voltage at the source electrode is equal to the voltage of the signal at the reference input end, the drain electrode is connected to the signal at the first power supply end. Since the voltage of the signal at the data signal end is lower than the voltage of the signal at the reference input end and the voltage of the signal at the reference input end is higher than a voltage at the first power supply end, the driving transistor is reverse biased, partial electrons captured in a forward bias in the driving display stage are recovered; hence, electric characteristic drifts in the driving transistor are eliminated, the current efficiency is recovered, and the service life of the driving transistor is prolonged.

It should be noted, voltages of signals at the first power supply end, the second power supply end, the reference input end and the data signal end in the driving display stage are respectively different from the voltages of the signals at the first power supply end, the second power supply end, the reference input end and the data signal end in the reverse bias time period.

Optionally, the voltage of the signal at the first power supply end in the reverse bias time period is lower than the voltage of the signal at the first power supply end in the driving display stage.

Optionally, the voltage of the signal at the second power supply end in the reverse bias time period is higher than the voltage of the signal at the second power supply end in the driving display stage.

Optionally, in order to recover the threshold voltage effectively, a difference between voltages of signals at the reference input end and the data signal end in the reverse bias time period is higher than a preset threshold.

Optionally, the voltage of the signal at the data signal end in the reverse bias time period is lower than the threshold voltage of the driving transistor.

Furthermore, in the embodiment of the present disclosure, the reverse biases of the organic light-emitting diode OLED and the driving transistor DTFT are achieved merely by inputting different control signals to the six input ends in the reverse bias time period without using additional devices. Hence, the pixel circuit has a simple structure, and meanwhile the service lives of the driving transistor and the OLED are prolonged.

The control circuit for the pixel circuit according to the embodiment of the present disclosure is described as above. The pixel circuit includes the driving transistor that is configured to drive the light-emitting element to emit light. The timing sequence of the control signal includes: the driving display stage and the non-display stage. The non-display stage includes the reverse bias time period. The control circuit is connected with the input end of the pixel circuit and is configured to input the first control signal to the input end of the pixel circuit in the reverse bias time period to make the light-emitting element and the driving transistor to be reverse biased. The reverse bias time period in the embodiment is a time period preselected from the non-display stage. In the embodiment of the present disclosure, electrons captured when the light-emitting element and the driving transistor are reverse biased can be recovered by realizing reverse biases of the light-emitting element and the driving transistor in the reverse bias time period, which not only eliminate electric characteristic drifts in the driving transistor and the OLED and recovers the current efficiency, but also prolongs service lives of the driving transistor and the OLED.

Based on the inventive concept described above, a display device is further provided in an embodiment of the present disclosure. The display device includes a pixel circuit and a control circuit. The control circuit of the display device is the control circuit according to the foregoing embodiments, so the implementation principle and implementation effects are not repeated herein.

The display device may include a display substrate provided with the pixel circuit thereon. Optionally, the display device may be an OLED panel, a cellular phone, a tablet computer, a television, a display, a laptop, a digital photo frame, a navigator or any product or component having a displaying function.

The display substrate of the display device according to an embodiment of the present disclosure may utilize a low temperature poly-silicon (LTPS) process, such design with multiple transistors and multiple capacitors may not adversely affect the aperture ratio of the module.

It should be explained that the display substrate of the display device according to some embodiments of the present disclosure may optionally utilize amorphous silicon process. It should be noted that the pixel circuit according to the embodiments of the present disclosure may use thin-film transistors fabricated through amorphous silicon process, poly-silicon process, oxide process and so on.

Types of thin-film transistors used in the pixel circuit according to the embodiment of the present disclosure may be changed according to actual needs. Although the above embodiments are described based on active matrix organic light-emitting diodes, the present disclosure is not limited to a display substrate using the active matrix organic light-emitting diodes and may be applied to a display substrate using other light-emitting diodes.

Optional embodiments are described hereinabove. It should be noted that various changes and replacements can be made by those ordinary skilled in the art without departing from the principle of the present disclosure, and those changes and replacements fall within the protection scope of the present disclosure.

What is claimed is:

1. A control method for a pixel circuit, wherein the pixel circuit comprises a driving transistor configured to drive a light-emitting element, a timing sequence of the pixel circuit comprises a driving display stage and a non-display stage, and the non-display stage comprises a reverse bias time period;

wherein the control method comprises: inputting, in the reverse bias time period, corresponding signals to input ends of the pixel circuit to make both the light-emitting element and the driving transistor reverse biased;

wherein the input ends of the pixel circuit comprise: a first scanning end, a second scanning end, a first power supply end, a second power supply end, a data signal end and a reference input end;

wherein the pixel circuit comprises a first switching transistor, a second switching transistor and a storage capacitor; the light-emitting element is a light-emitting diode; a gate electrode of the driving transistor is connected to the data signal end via the first switching transistor, a first electrode of the driving transistor is connected to the first power supply end, and a second electrode of the driving transistor is connected to an anode of the light-emitting diode; and the storage capacitor is arranged between the gate electrode and the second electrode of the driving transistor and is connected with the gate electrode and the second electrode of the driving transistor;

wherein the reference input end is connected to the anode of the light-emitting diode and the gate electrode of the driving transistor via the second switching transistor, and a cathode of the light-emitting diode is connected to the second power supply end; and wherein in the reverse bias time period, a voltage of the signal at the second power supply end is higher than a voltage of the signal at the reference input end, the voltage of the signal at the reference input end is higher than a voltage of the signal at the first power supply end, and the voltage of the signal at the first power supply end is higher than a voltage of the signal at the data signal end.

2. The control method according to claim 1, wherein the reverse bias time period is a time period preselected from the non-display stage.

3. The control method according to claim 1, wherein the voltage of the signal at the first power supply end in the reverse bias time period is lower than a voltage of the signal at the first power supply end in the driving display stage.

4. The control method according to claim 1, wherein the voltage of the signal at the second power supply end in the reverse bias time period is higher than a voltage of the signal at the second power supply end in the driving display stage.

5. The control method according to claim 1, wherein a difference between voltages of the signals at the reference input end and the data signal end in the reverse bias time period is higher than a first threshold.

6. The control method according to claim 1, wherein a voltage of the signal at the data signal end in the reverse bias time period is lower than a threshold voltage of the driving transistor.

7. The control method according to claim 1, wherein a gate electrode of the first switching transistor is connected to the first scanning end, a first electrode of the first switching transistor is connected to the data signal end, and a second electrode of the first switching transistor is connected to the gate electrode of the driving transistor;

a gate electrode of the second switching transistor is connected to the second scanning end, a first electrode of the second switching transistor is connected to the reference input end, and a second electrode of the second switching transistor is connected to the anode of the light-emitting diode and the gate electrode of the driving transistor; and the first switching transistor, the second switching transistor and the driving transistor each is an N-type thin-film transistor;

wherein in the reverse bias time period, each of the signals at the first scanning end, the second scanning end and the second power supply end is a high level, each of the signals at the first power supply end and the data signal end is a low level, the first switching transistor and the second switching transistor are each switched on, the low level signal at the data signal end is input to the gate electrode of the driving transistor via the first switching transistor to make the driving transistor to be reverse biased; and the signal at the reference input end is input to the anode of the light-emitting diode via the second switching transistor, the signal input to the cathode of the light-emitting diode from the second power supply end is higher than the voltage of the signal at the reference input end in such a manner that the light-emitting diode is reverse biased.

8. A control circuit for a pixel circuit, wherein the pixel circuit comprises a driving transistor configured to drive a light-emitting element, a timing sequence of the pixel circuit comprises a driving display stage and a non-display stage, and the non-display stage comprises a reverse bias time period;

wherein the control circuit is connected to input ends of the pixel circuit and is configured to input corresponding signals a first control signal to the input ends of the pixel circuit in the reverse bias time period to make both the light-emitting element and the driving transistor reverse biased;

wherein the input ends of the pixel circuit comprise: a first scanning end, a second scanning end, a first power supply end, a second power supply end, a data signal end and a reference input end;

wherein the pixel circuit comprises a first switching transistor, a second switching transistor and a storage capacitor; the light-emitting element is a light-emitting diode; a gate electrode of the driving transistor is connected to the data signal end via the first switching transistor, a first electrode of the driving transistor is connected to the first power supply end, and a second electrode of the driving transistor is connected to an anode of the light-emitting diode; and the storage capacitor is arranged between the gate electrode and the second electrode of the driving transistor and is connected with the gate electrode and the second electrode of the driving transistor;

wherein the reference input end is connected to the anode of the light-emitting diode and the gate electrode of the driving transistor via the second switching transistor, and a cathode of the light-emitting diode is connected to the second power supply end; and wherein in the reverse bias time period, a voltage of the signal at the second power supply end is higher than a voltage of the signal at the reference input end, the voltage of the signal at the reference input end is higher than a voltage of the signal at the first power supply end, and the voltage of the signal at the first power supply end is higher than a voltage of the signal at the data signal end.

9. The control circuit according to claim 8, wherein the reverse bias time period is a time period preselected from the non-display stage.

10. The control circuit according to claim 8, wherein the voltage of the signal at the first power supply end in the reverse bias time period is lower than a voltage of the signal at the first power supply end in the driving display stage.

11. The control circuit according to claim 8, wherein the voltage of the signal at the second power supply end in the reverse bias time period is higher than a voltage of the signal at the second power supply end in the driving display stage.

12. The control circuit according to claim 8, wherein a difference between voltages of the signals at the reference input end and the data signal end in the reverse bias time period is higher than a first threshold.

13. The control circuit according to claim 8, wherein a voltage of the signal at the data signal end in the reverse bias time period is lower than a threshold voltage of the driving transistor.

14. A display device, comprising a pixel circuit and a control circuit, wherein the pixel circuit comprises a driving transistor configured to drive a light-emitting element, a timing sequence of the pixel circuit comprises a driving display stage and a non-display stage, and the non-display stage comprises a reverse bias time period; and wherein the control circuit is connected to input ends of the pixel circuit and is configured to input corresponding signals to the input ends of the pixel circuit in the reverse bias time period to make both the light-emitting element and the driving transistor reverse biased, wherein the input ends of the pixel circuit comprise: a first scanning end, a second scanning end, a first power supply end, a second power supply end, a data signal end and a reference input end;

wherein the pixel circuit comprises a first switching transistor, a second switching transistor and a storage capacitor; the light-emitting element is a light-emitting diode; a gate electrode of the driving transistor is connected to the data signal end via the first switching transistor, a first electrode of the driving transistor is connected to the first power supply end, and a second electrode of the driving transistor is connected to an anode of the light-emitting diode; and the storage capacitor is arranged between the gate electrode and the second electrode of the driving transistor and is connected with the gate electrode and the second electrode of the driving transistor;

wherein the reference input end is connected to the anode of the light-emitting diode and the gate electrode of the driving transistor via the second switching transistor, and a cathode of the light-emitting diode is connected to the second power supply end; and wherein in the reverse bias time period, a voltage of the signal at the second power supply end is higher than a voltage of the signal at the reference input end, the voltage of the signal at the reference input end is higher than a voltage of the signal at the first power supply end, and the voltage of the signal at the first power supply end is higher than a voltage of the signal at the data signal end.

15. The display device according to claim 14, wherein the reverse bias time period is a time period preselected from the non-display stage.

16. The display device according to claim 14, wherein the voltage of the signal at the first power supply end in the reverse bias time period is lower than a voltage of the signal at the first power supply end in the driving display stage.

17. The display device according to claim 14, wherein the voltage of the signal at the second power supply end in the reverse bias time period is higher than a voltage of the signal at the second power supply end in the driving display stage.

18. The display device according to claim 14, wherein a difference between voltages of the signals at the reference input end and the data signal end in the reverse bias time period is higher than a first threshold.

19. The display device according to claim 14, wherein a voltage of the signal at the data signal end in the reverse bias time period is lower than a threshold voltage of the driving transistor.

20. The display device according to claim 14, wherein:

a gate electrode of the first switching transistor is connected to the first scanning end, a first electrode of the first switching transistor is connected to the data signal end, and a second electrode of the first switching transistor is connected to the gate electrode of the driving transistor;

a gate electrode of the second switching transistor is connected to the second scanning end, a first electrode of the second switching transistor is connected to the reference input end, and a second electrode of the second switching transistor is connected to the anode of the light-emitting diode and the gate electrode of the driving transistor; and the first switching transistor, the second switching transistor and the driving transistor each is an N-type thin-film transistor;

wherein in the reverse bias time period, each of the signals at the first scanning end, the second scanning end and the second power supply end is a high level, each of the signals at the first power supply end and the data signal end is a low level, the first switching transistor and the second switching transistor are each switched on, and the low level signal at the data signal end is input to the gate electrode of the driving transistor via the first switching transistor to make the driving transistor to be reverse biased; and wherein the signal at the reference input end is input to the anode of the light-emitting diode via the second switching transistor, and the signal input to the cathode of the light-emitting diode from the second power supply end is higher than the voltage of the signal at the reference input end in such a manner that the light-emitting diode is reverse biased.

* * * * *